US005378170A

United States Patent [19]

Abe et al.

[11] Patent Number: 5,378,170

[45] Date of Patent: Jan. 3, 1995

[54] TERMINAL INSERTING STRUCTURE OF CONNECTOR

[75] Inventors: Kimihiro Abe; Seiji Koumatsu, both of Shizuoka, Japan

[73] Assignee: Yazaki Corporation, Tokyo, Japan

[21] Appl. No.: 97,895

[22] Filed: Jul. 28, 1993

[30] Foreign Application Priority Data

Jul. 28, 1992 [JP] Japan ..... 4-201147

[51] Int. Cl.[6] ..... H01R 13/40

[52] U.S. Cl. ..... 439/595; 439/374; 439/751

[58] Field of Search ..... 439/587, 595, 596, 599, 439/600, 374, 465, 751

[56] References Cited

U.S. PATENT DOCUMENTS

| | | | |
|---|---|---|---|
| 4,784,617 | 11/1988 | Oda | 439/595 |
| 4,979,912 | 12/1990 | Shindo et al. | 439/595 |
| 5,108,309 | 4/1992 | Oda et al. | 439/595 |
| 5,211,583 | 5/1993 | Endo et al. | 439/595 |
| 5,244,421 | 9/1993 | Jinno et al. | 439/595 |

FOREIGN PATENT DOCUMENTS 55-47015 11/1980 Japan .

58-71986 5/1983 Japan .

*Primary Examiner*—David L. Pirlot

*Attorney, Agent, or Firm*—Sughrue, Mion, Zinn, Macpeak & Seas

[57] ABSTRACT

In a connector comprising: a connector housing having a terminal accommodating chamber with a flexible terminal locking extended in the latter; and a terminal having a male tab at the end, which is inserted into the terminal accommodating chamber with the male tab protruded through an opening of the terminal accommodating chamber; a pair of swing preventing protrusions are formed on the inner wall of the terminal accommodating chamber at the end on the side of the opening, which wall is confronted with the terminal locking arm, in such a manner that the protrusions form a hole for insertion of for the male tab, each of the swing preventing protrusions has a first sloped guide surface on the terminal insertion side, and a second sloped guide surface on the side in opposition to the terminal locking arm, and a male tab receivable space, which is relatively wide, is formed using the second sloped surfaces, whereby the terminal can be smoothly inserted into the connector housing without play.

8 Claims, 4 Drawing Sheets

TERMINAL INSERTING STRUCTURE OF CONNECTOR

BACKGROUND OF THE INVENTION

This invention relates to a connector, and more particularly to the terminal inserting structure thereof.

FIGS. 6 and 7 show a conventional connector, mere specifically the positional relationships between a terminal and a connector housing in it which has been disclosed by Japanese Utility Patent Application (OPI) No. 71986/1983 (the term "OPI" as used herein means an "unexamined published application").

The connector 25 comprises: a connector housing 29 of synthetic resin; and a male terminal 33. The connector housing 29 has a terminal accommodating chamber 26, from the ceiling 27 of which a flexible terminal locking arm 28 is protruded, and a terminal abutting wall 34, in which a lead-out opening 31 is formed. The male terminal 33 includes a box-shaped portion 30, and a male tab 32 which is the top end portion of the terminal. The rear end and the front end of the box-shaped portion 30 are abutted against the terminal locking art 28 and the terminal abutting wall 34, respectively. The male tab 32 is extended through the lead-out opening 31.

In the connector 25, as is apparent from FIG. 7 the male tab 32 is smaller in width and larger in length than the box-shaped portion 30 of the terminal 33. Hence, in the terminal accommodating chamber 26, the front and rear ends 30*a* and 30*b* of the box-shaped portion 30 are liable to be diagonally brought into point contact with the wall of the terminal accommodating chamber; that is, the male tab 32 is greatly rotated in the direction of width, which makes it difficult to engage the male terminal with the mating female terminal. In the case where the terminal is inserted into the connector housing obliquely from below, the front end of the male tab 32 is struck against the terminal abutting wall 34. As a result, the male tab 32 may be deformed or the connector housing 29 may be damaged.

SUMMARY OF THE INVENTION

In view of the foregoing, an object of this invention is to provide a terminal inserting structure for a connector, which prevents the swinging of the male tab, and which allows the smooth insertion of the terminal into the connector housing even when the terminal is obliquely inserted into the latter.

The foregoing object and other objects of the invention have been achieved by the provision of a terminal inserting structure for a connector comprising a connector housing having a terminal accommodating chamber with a flexible terminal locking arm extended therein, and a terminal having a male tab at the end, which is inserted into the terminal accommodating chamber with the male tab extended through an opening of the terminal accommodating chamber; in which structure, according to the invention, a pair of swing preventing protrusions are formed on the inner wall of the terminal accommodating chamber at the end on the side of the opening, which wall is confronted with the terminal locking arm, in such a manner that the protrusions form a hole for insertion of the male tab, each of the swing preventing protrusions has a first sloped guide surface on the terminal insertion side, and a second sloped guide surface on the side in opposition to the terminal locking arm, and a male tab receivable space, which is relatively wide, is formed using the second sloped surfaces.

With the terminal inserting structure of the invention, the male tab of the terminal is moved down the first sloped guide surface into the narrow space between the pair of swing preventing protrusions and held stably therein. When the terminal is inserted obliquely into the connector housing, the male tab is led into the male tab receivable space which is relatively wide, while the terminal is pushed back to the inner wall of the terminal accommodating chamber by the resiliency of the terminal locking arm. Therefore, the male tab is slid down the second sloped guide into the narrow space between the pair of swing preventing protrusions, thus being prevented from swinging laterally.

The nature, principle, and utility of the invention will be more clearly understood from the following detailed description of the invention when read in conjunction with the accompanying drawings.

BRIEF DESCRIPTION OF THE DRAWING(S)

Figure 4A:
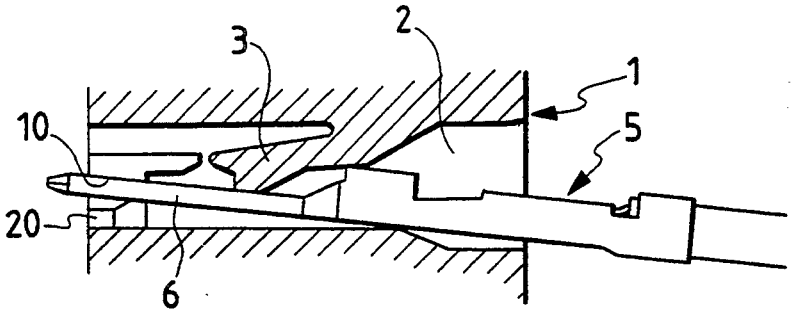
Figure 4B:
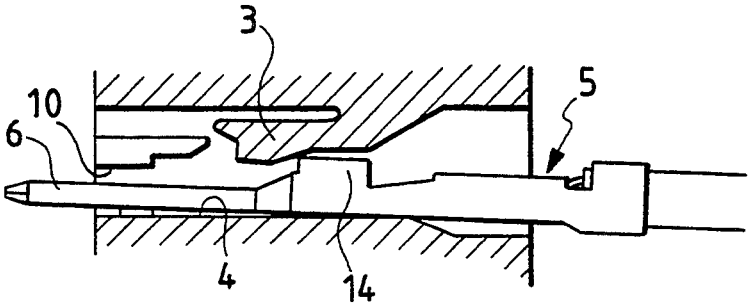
Figure 4C:
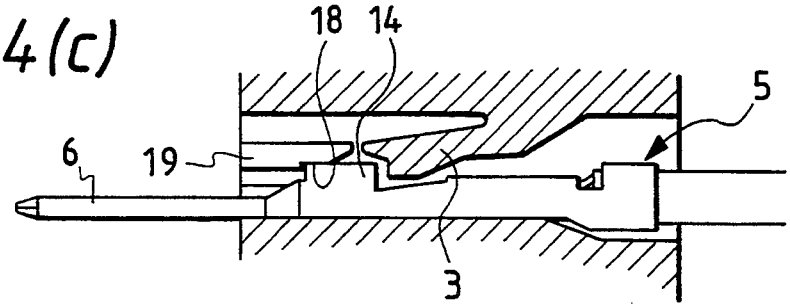

The parts (a) through (c) of FIG. 4 are longitudinal sectional views for a description of the function of the terminal inserting structure—more specifically, the part (a) of FIG. 4 shows a terminal inserted obliquely in a connector housing, the part (b) of FIG. 4 shows the terminal depressed by a terminal locking arm, and the part (c) of FIG. 4 shows the terminal inserted in place.

Figure 5A:
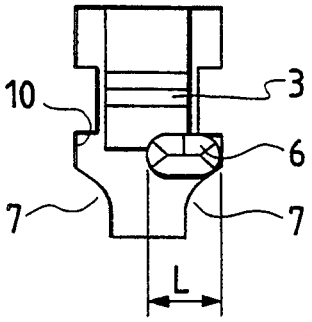
Figure 5B:
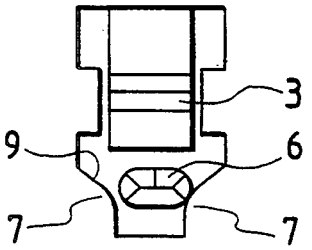
Figure 5C:
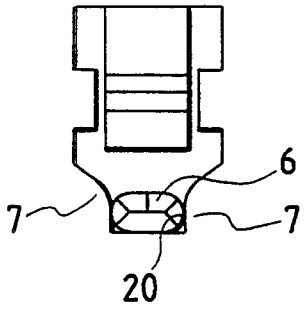

The parts (a) through (c) of FIG. 5 are side views for describing the function of the terminal inserting structure in association with the parts (a) through (c) of FIG. 4—more specifically, part (a) of FIG. 5 shows the male tab of the terminal inserted into a male tab receivable space, part (b) of FIG. 5 shows the box-shaped portion of the terminal depressed by the terminal locking arm, and part (c) of FIG. 5 shows the terminal inserted in place.

Figure 6:
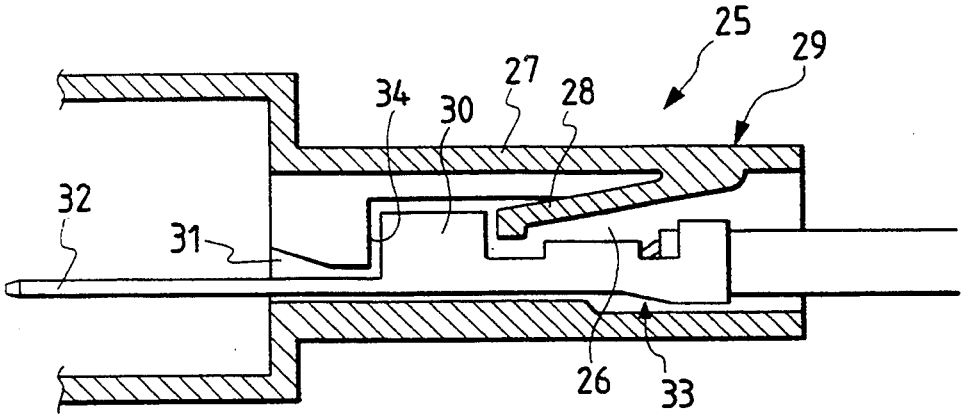
FIG. 6 PRIOR ART
Figure 7:
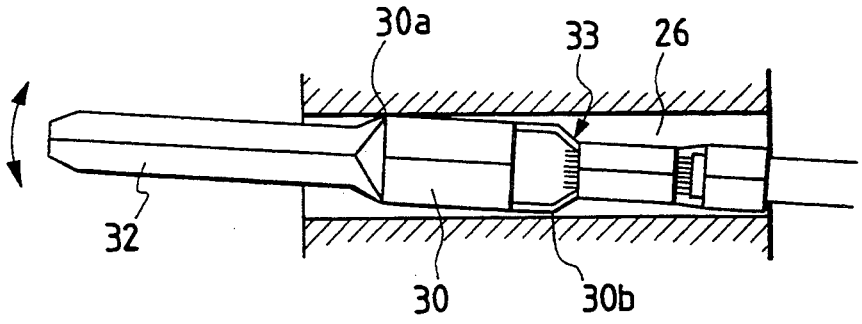
FIG. 7 PRIOR ART

FIG. 6 is a vertical sectional view of a connector having a conventional terminal inserting structure; and FIG. 7 is a horizontal sectional view showing a state of the terminal of the connector shown in FIG. 6.

DETAILED DESCRIPTION OF THE INVENTION

Figure 1:
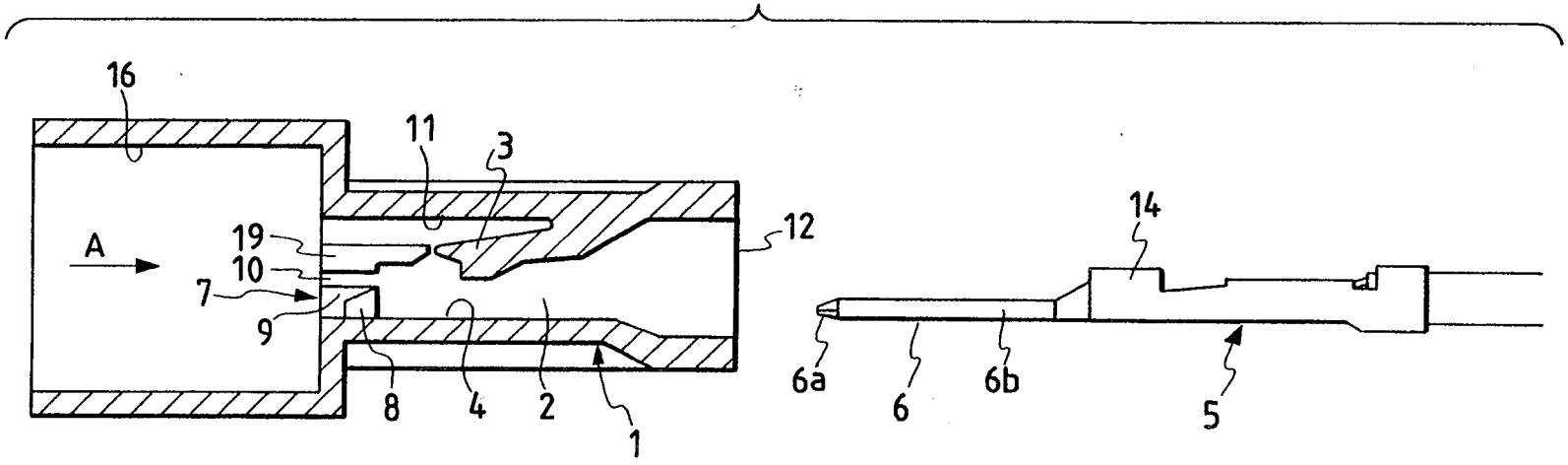
FIG. 1 is a longitudinal sectional view showing one example of a connector having a terminal inserting structure according to this invention.
Figure 2:
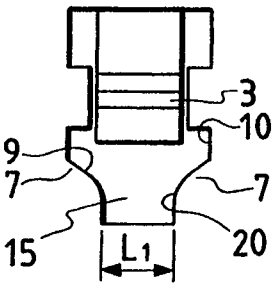
FIG. 2 is a side view of the connector as viewed in the direction of the arrow A.
Figure 3:
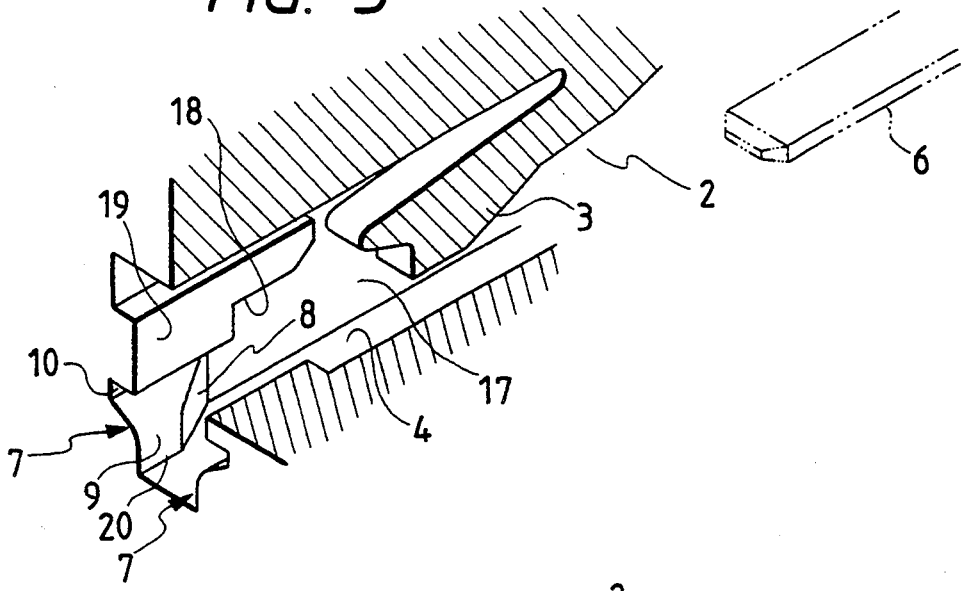
FIG. 3 is a perspective view, with parts cut away, showing essential parts of the terminal inserting structure according to the invention.

One example of a connector having a terminal inserting structure according to this invention will be described with reference to FIGS. 1 through 3.

A specific feature of the terminal inserting structure of the invention resides in that, in a connector housing 1 having a terminal accommodating chamber 2, a pair of swing preventing protrusions 7 and 7, acting on a male tab 6 which is the front end portion of a male terminal 5, are formed on the inner wall of the terminal accommodating chamber 2 at the end on the side of a terminal lead-out opening 15, which wall is confronted with a flexible terminal locking arm extending into the terminal accommodating chamber 2, first and second guide surfaces 8 and 9 are formed on the rear end portion (on the terminal insertion side) and the upper portion (confronted with the terminal locking arm) of each swing preventing protrusion 7 for guiding the male tab 6, and a relatively wide male tab receivable space 10 is formed using the second guide surfaces 9. This will be described in more detail.

The connector housing 1 is made of synthetic resin similarly as in the case of the above-described conventional connector. The connector housing 1 has the terminal accommodating chamber 2, from the ceiling of which the terminal locking arm 3 is protruded obliquely forwardly. In the connector housing 1, the terminal locking arm 3 locks a box-shaped portion 14 of the terminal 5 which is inserted into the connector housing through the rear opening 12 of the terminal accommodating chamber 2, while the male tab 6 of the terminal 5 is inserted into a connector engaging chamber 16 through the front opening 15 of the terminal accommodating chamber 2.

The swing preventing protrusions 7 from the bottom wall 4 of the terminal accommodating chamber 2 near the front opening 15 in such a manner that they merge with the side walls 17. The pair of swing preventing protrusions 7 and 7 are spaced from each other by a distance $L_1$ which is substantially equal to the width L of the male tab which is smaller than that of the box-shaped portion 14 of the terminal 15, thus forming a male tab insertion hole 20 which is relatively narrow. The swing preventing protrusions 7 have the first sloped guide surfaces 8 which are so formed that the distance between them is gradually smaller towards the front opening 15 in correspondence to the front end portion 6*a* of the male tab 6, and the second sloped guide surfaces 9 which are curved from the bottom wall 4 to the side walls 17 in correspondence to both side portions 6*b* of the male tab 6.

In addition, above the swing preventing protrusions 7, rectangular block shaped terminal abutting walls 19 are protruded from the side walls 17 of the terminal accommodating chamber 2 in such a manner that they are confronted with the second sloped guide surfaces 9. Each of the terminal abutting walls 19 has a step 18 for supporting the box-shaped portion 14 of the terminal 5. The male tab receivable space 10 is formed between the male tab insertion hole 20 and the terminal abutting walls 19. The space 10 is wider both horizontally and vertically than the male tab 6. The male tab inserting permitting space 10 serves as follows: That is, when the terminal is inserted obliquely into the connector housing, the space 10 receives the male tab 6 of the terminal thus inserted, and acts as a loose guide hole when the male tab 6 is moved down the second sloped guide surface 9 of the swing preventing protrusion 7.

In the case where the terminal 5 is inserted into the connector housing slightly obliquely from below as shown in the part (a) of FIG. 4 and the part (a) of FIG. 5, the male tab 6 can be inserted into the male tab receivable space 10; however, as shown in the part (b) of FIG. 4 and the part (b) of FIG. 5, the box-shaped portion 14 of the terminal 5 is depressed by the resiliency of the flexible terminal locking arm 3, so that the terminal 5 is pushed towards the bottom wall 4.

In this operation, the male tab 6 is slid down the second sloped guide surface 9 of the swing preventing protrusion 7. As a result, as shown in the part (c) of FIG. 4 and the part (c) of FIG. 5, the male tab 6 is fitted in the narrow insertion hole 20 between the pair of swing preventing protrusions 7 and 7, thus being prevented from swinging laterally. The first sloped guide surface 8 acts as guide means for guiding the male tab when inserted into the connector housing, thus allowing the smooth insertion of the terminal. The terminal is stably held, with the front end portion of the box-shaped portion 14 abutted against the steps of the terminal abutting walls 19 and with the rear end portion locked to the terminal locking arm 3.

With the terminal inserting structure of the invention, the male tab of the terminal can be smoothly inserted along the first sloped guide surface into the connector housing, and can be stably held between the pair of swing preventing protrusions, which makes it possible for the terminal to engage with the mating female terminal. Even when the terminal is obliquely inserted into the connector housing, owing to the resiliency of the terminal locking arm, the male tab is moved from the male tab receiving space and slid down the second slope guide surface into the narrow space between the pair of swing preventing protrusion, thus being stably held there. Hence, with the terminal inserting structure of the invention, the terminal inserting operation can be achieved with high efficiency, and the above-described difficulties accompanying the conventional terminal inserting structure can be eliminated that the male tab is deformed and the connector housing is damaged.

While there has been described in connection with the preferred embodiment of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector comprising:

a connector housing (1) having a terminal accommodating chamber (2) with a flexible terminal locking arm (3) extended therein, said terminal accommodating chamber being adapted to receive a terminal (5) inserted into said terminal accommodating chamber (2) to a first end from a second end of said terminal accommodating chamber (2), said terminal (5) having a male tab (6) at the end thereof, said male tab (6) protruding through an opening (15) of said terminal accommodating chamber (2) when disposed therein;

a pair of swing preventing protrusions, for preventing lateral rotation of the terminals (7) respectively formed on opposite inner lateral side walls of said terminal accommodating chamber (2) at said first end, which walls are confronted with the terminal locking arm (3), in such a manner that a male tab insertion hole (20) for insertion of the male tab (6) is partially defined by said pair of swing preventing protrusions (7), wherein each of said swing preventing protrusions (7) has a first sloped guide surface (8) on the second end, and a second sloped guide surface (9) on the first end in opposition to said terminal locking arm (3), said first sloped guide surfaces being sloped in a terminal insertion direction to facilitate insertion of said terminal and said second sloped guide surfaces being sloped in a downward direction to facilitate downward centering movement of the male tab upon insertion thereof, and a male tab receivable space (10) having a width wider than said male tab (6) in a cross section is formed in opposition to said second sloped surfaces of said swing preventing protrusions.

2. A connector according to claim 1, in which said first sloped guide surfaces (8) of said swing preventing protrusions (7) are so formed that a distance between said first sloped guide surfaces (8) is gradually smaller towards the first end.

3. A connector according to claim 2, in which the smallest distance between said first sloped guide surfaces (8) is substantially equal to the width of said male tab (6).

4. A connector according to claim 1, in which said second sloped guide surfaces (9) are so curved that a distance between said second sloped guide surfaces (9) is gradually decreased in a downward direction.

5. A connector according to claim 4, in which the smallest distance between said second sloped guide surfaces (9) is substantially equal to the width of said mail tab (6).

6. A connector according to claim 1, further comprising:

terminal abutting walls (19) formed on the inner wall of said terminal accommodating chamber (2) in such a manner that said terminal abutting walls (19) are confronted with said second sloped guide surfaces (9).

7. A connector according to claim 6, in which said male tab receivable space (10) is formed between said male tab insertion hole (20) and said terminal abutting walls (19).

8. A connector according to claim 7, in which said male tab receivable space (10) is wider both horizontally and vertically than said male tab (6).

* * * * *